US009488327B2

(12) United States Patent
Van Gheluwe et al.

(10) Patent No.: US 9,488,327 B2
(45) Date of Patent: Nov. 8, 2016

(54) LIGHTING SYSTEM

(71) Applicant: PHILIPS LIGHTING HOLDING B.V., Eindhoven (NL)

(72) Inventors: Jochen Renaat Van Gheluwe, Eindhoven (NL); Berent Willem Meerbeek, Eindhoven (NL); Petrus Johannes Hendrikus Seuntiens, Eindhoven (NL); Jacobus Dingenis Machiel Van Boven, Eindhoven (NL); Evert Jan Van Loenen, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/029,422

(22) PCT Filed: Oct. 1, 2014

(86) PCT No.: PCT/EP2014/070997
§ 371 (c)(1),
(2) Date: Apr. 14, 2016

(87) PCT Pub. No.: WO2015/055430
PCT Pub. Date: Apr. 23, 2015

(65) Prior Publication Data

US 2016/0273723 A1 Sep. 22, 2016

(30) Foreign Application Priority Data

Oct. 14, 2013 (EP) ..... 13188575

(51) Int. Cl.

| | |
|---|---|
| ***F21S 10/00*** | (2006.01) |
| ***F21V 33/00*** | (2006.01) |
| ***F21V 7/00*** | (2006.01) |
| ***H05B 33/08*** | (2006.01) |
| ***F21S 8/02*** | (2006.01) |
| *F21Y 101/02* | (2006.01) |

(52) U.S. Cl.
CPC ..... *F21S 10/00* (2013.01); *F21S 8/026* (2013.01); *F21V 7/0008* (2013.01); *F21V 33/006* (2013.01); *H05B 33/0845* (2013.01); *H05B 33/0857* (2013.01); *H05B 33/0896* (2013.01); *F21Y 2101/02* (2013.01)

(58) Field of Classification Search
CPC ..... F21S 10/00; F21S 8/026; F21V 7/0008; F21V 33/006; H05B 33/0845; H05B 33/0857; H05B 33/0896
See application file for complete search history.

(56) References Cited

U.S. PATENT DOCUMENTS

| | | | |
|---|---|---|---|
| 1,607,922 | A | 11/1926 | Schweitzer |
| 7,543,956 | B2 | 6/2009 | Piepgras et al. |
| 2009/0273302 | A1 | 11/2009 | Straats et al. |

(Continued)

FOREIGN PATENT DOCUMENTS

| | | | |
|---|---|---|---|
| DE | 29506194 | U | 10/1995 |
| DE | 202008001960 | U1 | 6/2008 |

(Continued)

*Primary Examiner* — Mary Ellen Bowman

(57) ABSTRACT

A lighting system has a recessed panel (light source or window) and a side wall or a set of side walls around the recess. The side wall (or at least one of the side walls), is provided with a lighting arrangement for controlling the color of illumination and/or shape from which light is emitted from the side wall or side walls. This can be used to replicate the sharp lighting boundaries that arise on the recess walls from sun illumination through a skylight, or else they can be used to provide general illumination around a window.

13 Claims, 4 Drawing Sheets

(56) References Cited

U.S. PATENT DOCUMENTS

| | | | | |
|---|---|---|---|---|
| 2010/0165606 | A1 | 7/2010 | Paterson | |
| 2013/0106294 | A1 | 5/2013 | Rakuff et al. | |
| 2013/0307420 | A1* | 11/2013 | Yoder | F21V 33/006 315/158 |
| 2014/0103833 | A1* | 4/2014 | Ho | H05B 33/0896 315/291 |

FOREIGN PATENT DOCUMENTS

| | | | |
|---|---|---|---|
| JP | 2008202283 | A | 9/2008 |
| WO | WO9632560 | A1 | 10/1996 |
| WO | WO2012122511 | A1 | 9/2012 |
| WO | WO2012140579 | A2 | 10/2012 |
| WO | WO2013011410 | A1 | 1/2013 |
| WO | WO2013011481 | A2 | 1/2013 |

* cited by examiner

LIGHTING SYSTEM

CROSS-REFERENCE TO PRIOR APPLICATIONS

This application is the U.S. National Phase application under 35 U.S.C. §371 of International Application No. PCT/EP2014/070997, filed on Oct. 1, 2014, which claims the benefit of European Application Number 13188575.8, filed Oct. 14, 2013. These applications are hereby incorporated by reference herein.

FIELD OF THE INVENTION

This invention relates to interior lighting systems.

BACKGROUND OF THE INVENTION

People generally prefer daylight over artificial light as their primary source of illumination. Everybody recognizes the importance of daylight in our daily lives. Daylight is known to be important for people's health and well-being.

In general, people spend over 90% of their time indoors, and often away from natural daylight. There is therefore a need for artificial daylight sources that create convincing daylight impressions with artificial light, in environments that lack natural daylight including homes, schools, shops, offices, hospital rooms, and bathrooms.

Artificial daylight sources on the market focus mainly on high intensity, tuneable color temperature, and slow dynamics (day/night rhythms). It is also known to create the appearance of a window in a ceiling facing the sky using a display or foil, for example by displaying a blue sky appearance or the appearance of a cloudy sky.

There has been significant development of lighting systems which try to emulate daylight even more faithfully. For example, such lighting systems are used as artificial skylights, which attempt to emulate natural daylight that would be received through a real skylight. To enhance the realism of the artificial skylight, the skylight solution is usually mounted in a recess in the ceiling, in the same way that a real skylight would be mounted.

One approach which has been proposed previously by the applicant is to create a blue (i.e. clear sky) appearance when looking at a skylight at an angle, for example 40 to 90 degrees, but still emit mainly white light in a beam directed parallel to the normal direction of the skylight surface, i.e. downward. This provides functional white light in a downward direction and more blue light at angles to the normal.

The sides of the recess are by definition located at the edge of the artificial skylight, and they diffusely reflect the light emitted by the skylight under large angles, i.e. blue light for the type of light unit outlined above. Although the intensity of the blue light is typically low, it causes the (typically white) surface of the recess of the skylight to appear bluish or at least very cold white. This does not occur with a real skylight and thus diminishes the effect that is aimed to be achieved with the artificial skylight solution.

The luminance of this reflected light is also rather low, whereas with a real skylight the white wall of a recess would appear very bright, since it is directly next to the skylight.

There is therefore a need for a recessed lighting system which better simulates daylight.

SUMMARY OF THE INVENTION

The invention is defined by the claims.

According to the invention, there is provided a lighting system comprising:

a light transmitting or light generating area; and a side wall or a set of side walls around the light transmitting or light generating area, defining a recess, wherein:

the light transmitting or light generating area is located at the base of the recess, and the side wall, or at least one of the side walls, is provided with a lighting arrangement for controlling the color and/or intensity and/or contrast of the illumination and/or shape from which light is provided by the side wall or side walls, or provided by an opposing side wall or side walls, said side wall or at least one of the side walls further comprising a rectangular light emitting area formed from two independently controllable triangular light emitting areas.

This lighting system replaces a standard passive recess in which a light panel is housed by light emitting surfaces. The light emitting surfaces can emit white and/or colored light for example with a Lambertian intensity distribution.

In this way, the appearance of the side walls can be made to match the lighting effect being desired from the light transmitting or light generating area.

The term light intensity encompasses such related terms as; luminance (the amount of light coming from a surface), illuminance (the amount of light striking a surface), luminous emittance (light emitted by a light source) and luminous intensity (the amount of light emitted in a given direction). Also related is brightness which is an attribute of visual perception in which a source appears to be radiating or reflecting light. It is a subjective attribute of the object being observed.

Luminance is a photometric measure of the luminous intensity per unit area of light travelling in a given direction. It describes the amount of light that passes through or is emitted from, a particular area, and that falls within a given solid angle. The SI unit of measurement for luminance is candela per square meter ($cd/m^2$). Luminance is often used to characterize emission or reflection from flat, diffuse surfaces. The luminance indicates how much luminous power will be detected by an eye looking at the surface from a particular angle of view. Luminance is thus an indicator of how bright the surface will appear Illuminance is a measurement of the total luminous flux incident on a surface, per unit area. It is a measure of how much incident light illuminates the surface, wavelength-weighted by the luminosity function to correlate with human brightness perception. The SI unit for illuminance is lux (lx) or lumens per square meter.

Luminous emittance is the luminous flux per unit area emitted from a surface. The luminous flux is the total perceived power emitted in all directions.

Luminous intensity is a measure of the wavelength-weighted power emitted by a light source in a particular direction per unit solid angle, based on the luminosity function, a standardized model of the sensitivity of the human eye. The SI unit of luminous intensity is the candela (cd).

The contrast is the difference in luminance and/or color determined between an object and other objects in the same field of view, that is to say that the two independently controllable triangular light emitting areas may have a contrast between them, i.e. they may have a different color and/or a different luminance from each other.

In one example, the system comprises a set of side walls, wherein each side wall comprises a rectangular light emitting area. This defines a basic recess for a polygonal panel.

In a first example, again with a set of side walls, each side wall can comprise a rectangular light emitting area formed from two independently controllable triangular light emitting areas. With one triangle illuminated, an effect of a sharp boundary can be created, which can replicate the sharp lines created by a distant point light source such as the sun. In this way, a triangular illumination shape can appear to have been created by a sunlit light transmitting or generating area. If both triangles are illuminated, the side wall can appear to face the sun, whereas if one is illuminated the side wall can appear to be laterally disposed with respect to the sun. If neither triangle is illuminated, the side wall can appear to be in the shade.

In another example, again with a set of side walls, each side wall can comprise a rectangular light emitting area formed from four independently controllable triangular light emitting areas, each having an apex at the center of the rectangular area. This means that triangles can be defined with opposite slopes. This means the lighting system does not need to be oriented in any particular way in order for the shadows created by the sun to be replicated.

In another example, again with a set of side walls, two side walls can each comprise a rectangular light emitting area formed from a plurality of independently controllable triangular light emitting areas, each having an apex at one corner of the rectangular area. This means that triangles can be defined with varying slopes. This means the lighting system can replicate the lines cast by the sun at different heights in the sky representing different times of day. There can be four side walls, wherein the two side walls (with the multiple triangles) face each other, and the other two side walls are provided with a plurality of rectangular light emitting areas.

The laterally disposed side walls (with respect to the direction of incoming light from the sun) have the triangles, whereas the front and back walls have the rectangles. This means all four side walls can be controlled to provide an overall impression matching sun illumination from a particular sun position.

The light transmitting or light generating area typically comprises a rectangle or square, but other shapes are possible.

In one set of examples, the light transmitting or light generating area comprises a light source. The light source is then intended to replicate natural daylight, or even natural lighting from the moon or stars. The use of lighting on the side walls helps to increase the realism of the lighting system. The lighting system can be used as an artificial window in a ceiling, but it can also be used as an artificial vertical window in a wall.

The light source can provide a first color for light emitted in a normal direction with respect to the light generating area, and a second, different, color for light emitted in a direction offset from the normal direction. For example, the second color can have a greater blue component than the first color. This arrangement functions as an artificial skylight, i.e. a system which provides an appearance aiming to replicate the appearance of a ceiling window when illuminated by daylight (either direct sunlight or general light for example as would be seen during a cloudy day). This arrangement provides whiter downward task light (representing the sun) and bluer light in other directions (representing the sky during daylight hours). The side wall illumination can prevent the side walls appearing blue, which does not match the effect observed through a real window.

In this way, the illuminated side wall or side walls compensate for the incident blue light from the artificial skylight, so the walls of the recess appear white (or any other color/color temperature of the sunlight that is desired) to an observer. Apart from the color issue, bright recess walls enhance the realism of the sunlight effect. As explained above, even further realism can be provided by forming a sharply demarcated light/dark boundary. These measures can be used to greatly enhance the realism of the artificial skylight solution.

The system preferably has a controller, for controlling the light source of the transmitting or light generating area in synchronism with the lighting arrangement of the side wall or side walls.

In a second set of examples, the light transmitting or light generating area comprises a window. In this way, the side walls can be used to provide illumination when it is dark, and they can be used to generate lighting effects. For example, additional light can be provided during cloudy days, to create the impression of a sunnier day.

The lighting arrangement of the side wall or each side wall can be for emitting light from the side wall or side walls to an observer. However, an alternative is for the lighting arrangement of the side wall or each side wall is to emit light from the side wall or side walls to an opposing side wall or opposing part of the side wall, for reflection to the observer.

The lighting arrangement of the side wall or each side wall can have a controllable output color.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides a lighting system having a recessed panel (which can be a light generating area such as a light source or a light transmitting area such as a window) and a side wall or a set of side walls around the recess. The side wall (or at least one of the side walls), is provided with a lighting arrangement for controlling the color of illumination and/or shape from which light is emitted from the side wall or side walls. This can be used to replicate the sharp lighting boundaries that arise on the recess walls from sun illumination through a skylight, or else they can be used to provide general illumination around a window.

Figure 1:
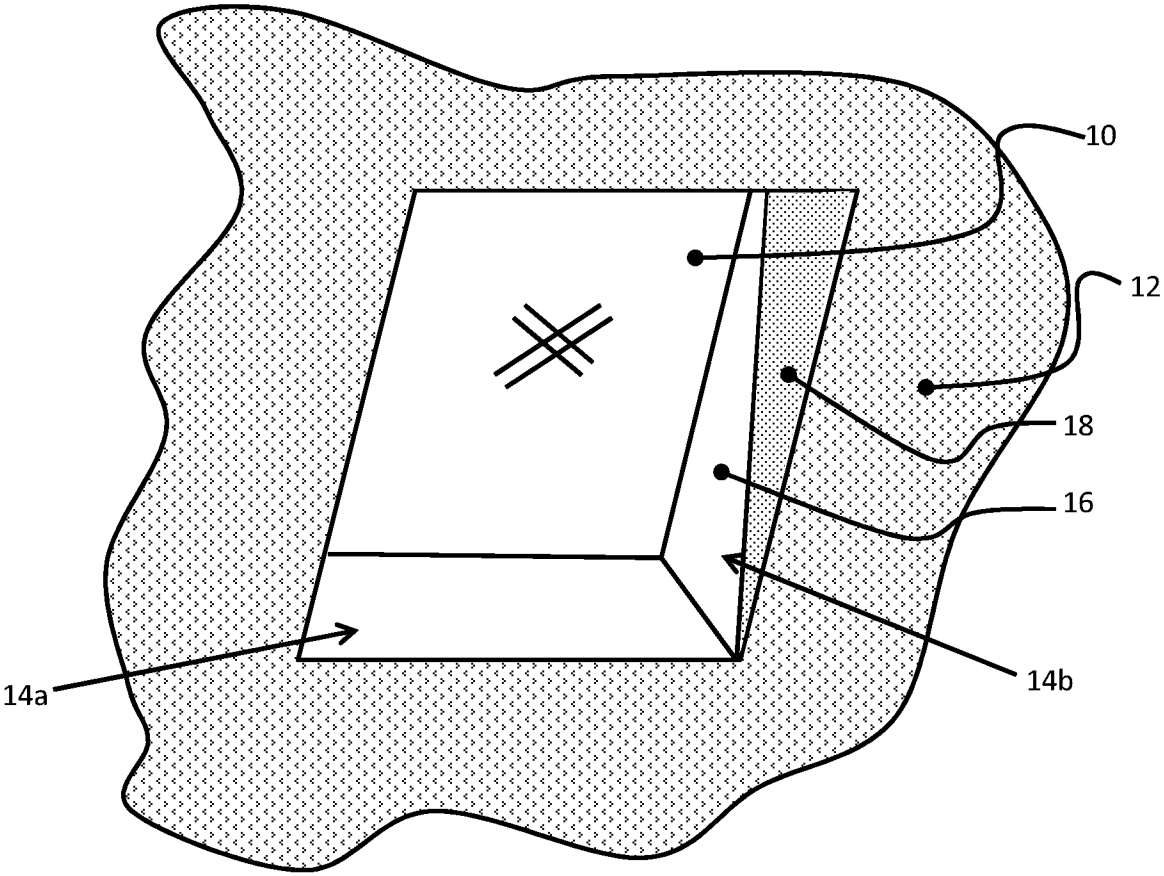
FIG. 1 shows a lighting panel in the form of a recessed skylight or a recessed artificial skylight.

FIG. 1 shows a lighting panel in the form of a recessed skylight or a recessed artificial skylight. The lighting panel is recessed into a ceiling 12, so that it sits at the bottom of a recess formed of side walls, two of which 14*a*, 14*b* can be seen in FIG. 1.

In the case of a real skylight, sharp shadows are formed at the sides, such as side wall 14*b*. The side wall facing the sun (in this case side wall 14*a*) is fully illuminated, and the side opposite to side wall 14*a* is fully shaded.

As shown for side wall 14*b*, there is an illuminated part 16 and a shaded part 18, with a relatively sharp visible boundary.

Artificial skylights are known, in which a lighting unit takes the place of the window of a real skylight. However, because the artificial skylight does not replicate a distant point source (the sun), the side walls are not illuminated in a realistic way.

The invention provides illumination from (or to) the side walls, so that various effects can be obtained, including for example a more realistic appearance.

Figure 2:
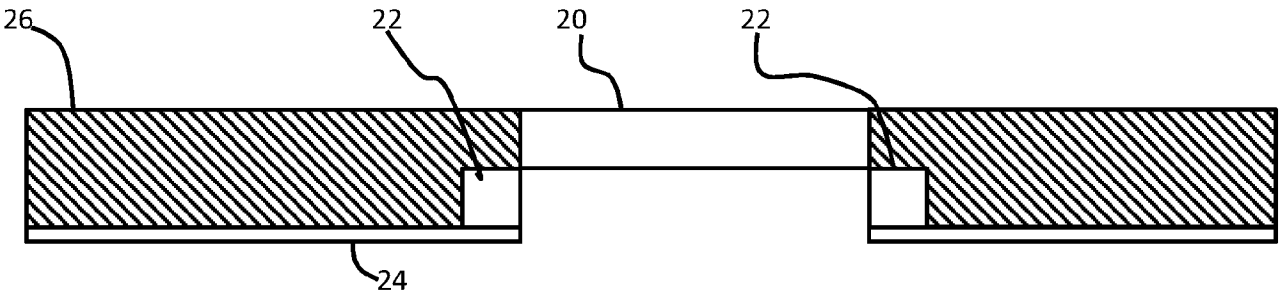
FIG. 2 shows a lighting system of the invention.

FIG. 2 shows a lighting system of the invention when applied to an artificial skylight. The lighting unit comprises a lighting panel 20 which sits at the bottom of a recess. The side walls of the recess have further lighting panels 22. The ceiling finish, such as plasterboard, is shown as 24 and the ceiling structure is shown as 26.

Figure 3:
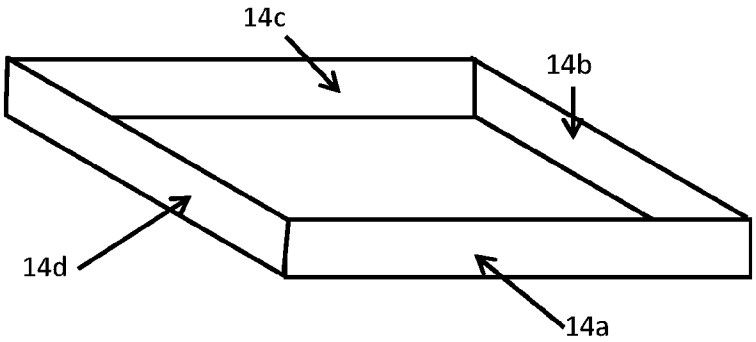
FIG. 3 shows the four side walls of a rectangular or square recess, and is used to explain different examples of the invention.

FIG. 3 shows how for a square or rectangular recess, there are four rectangular side walls, labeled 14*a*, 14*b*, 14*c*, 14*d*. These side walls may all be provided with the same lighting arrangement, or they may be different. Various examples are described below to make clear some of the possibilities.

In a most basic embodiment, all four side walls of the recess can emit light, and each emits light homogenously over its entire surface. This means each recess wall consists of a single rectangular light emitting segment that can be switched on or off or can be dimmed to a value between 0% and 100% of the maximum light intensity.

Again, in a most simple embodiment, all recess wall light sources can be switched on simultaneously. This does not replicate directional illumination from the sun, but it does mean the side walls have a controlled appearance, such as color.

This color control is of interest for some artificial skylight panels, in which a bluish ambient light is emitted at steep angles to the normal direction. This bluish light replicates the sky color. The side walls of the recess will be illuminated by this steep ambient light rather than by the whiter light emitted normally. This means that the side walls can have a false bluish appearance.

By providing light sources at the side walls, the appearance of the side walls can be controlled.

Some perception of direction can also be achieved with side walls in the form of rectangular light sources. To create the appearance of a directional effect caused by the sun, two adjacent walls can be switched on, such as side walls 14*a* and 14*b*, to simulate sun coming from the direction of the corner between side walls 14*c* and 14*d*. The recess walls that are switched off (14*c* and 14*d* in this example) can also be merely dimmed to a lower intensity than the recess side wall light sources that are switched on to a higher intensity.

Figure 4:
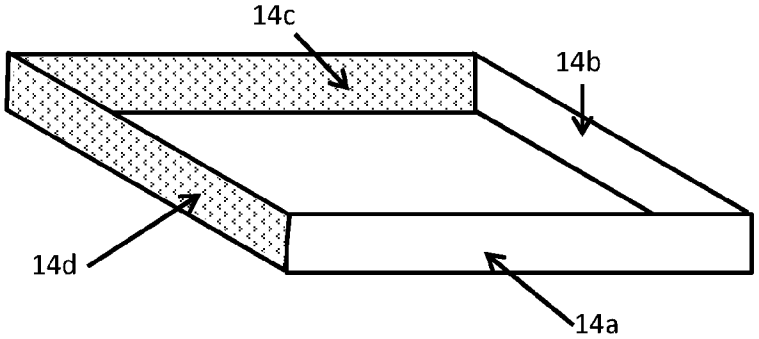
FIG. 4 shows how a first design of side wall in accordance with the invention, with side walls in the form of single light emitting areas, can be used to create a crude directional effect.

This effect is shown in FIG. 4.

In this example, the light sources provide an output over the full area of each side wall. A single light source per side wall can thus be used.

As a first example, the light source can comprise an edge lit light guide with an out-coupling pattern on its surface (such as paint dots, or surface roughness) or scattering particles or structures formed within its structure. The light sources can be LEDs at one or more edges of a lightguide structure.

As a second example, the light source can be an OLED (organic LED) lighting panel.

As a third example, the light source can consist of an array of low or medium power LEDs in a white mixing box. The mixing box is covered by a diffuser to create a homogeneous emitting surface.

These possible light source designs can also be applied to the multiple segmented designs described below.

Different lighting solutions generate different lighting effects, and require a different amount of installation space. For example, a light mixing box can require a certain distance between the LEDs and the diffuser in order to make the light effect homogeneous, and this implies a certain thickness to the unit. By way of example, depending on the pitch of the LEDs and the strength of the diffuser used, this thickness can typically vary between 1 and 10 cm.

To give the appearance of a standard painted matt wall when switched off, the light emitting surfaces can be covered with a matt diffuser or a thin piece of translucent white fabric or a thin translucent layer of white paint.

The example above uses side walls with a single light source emitting light over the full area of the side wall.

For a more realistic replication of the illumination provided by the sun, light sources having multiple segments can be used, that can be individually addressed (switched on/off/dimmed).

Figure 5:
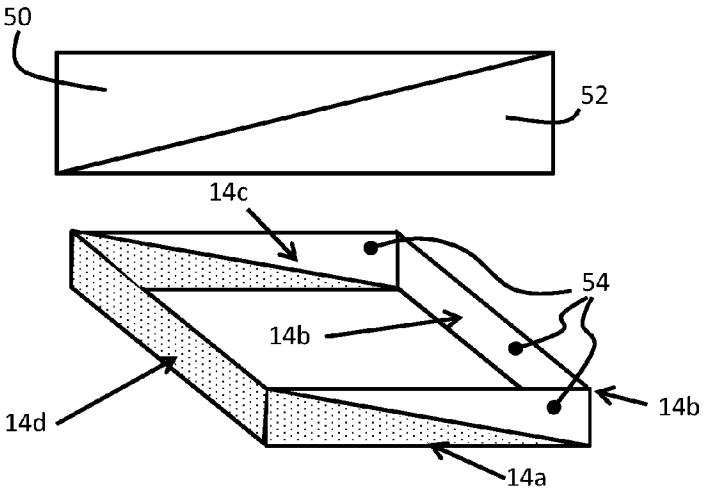
FIG. 5 shows a second design of side wall in accordance with the invention.

FIG. 5 shows a side wall design in the form of a rectangular light emitting area formed from two independently controllable triangular light emitting areas 50, 52.

When both segments are switched on, the wall is emitting light homogeneously, while if only one segment 50 is switched on and the other segment 52 is dimmed or switched off, a sharp edged pattern is created which replicates the effect of the sun in a certain position.

As explained with reference to FIG. 1, the recess side walls which are positioned laterally with respect to the emulated direction of incident sunlight will have the triangular illumination pattern. The side wall facing the sun will be fully illuminated and the other side wall will be in the shade.

FIG. 5 also shows this effect, with the brighter illumination areas shows as 54. Side walls 14*a* and 14*c* are controlled to provide a triangular pattern, whereas side walls 14*b* and 14*d* have a rectangular light output pattern.

This principle can be extended by using more segments.

Figure 6:
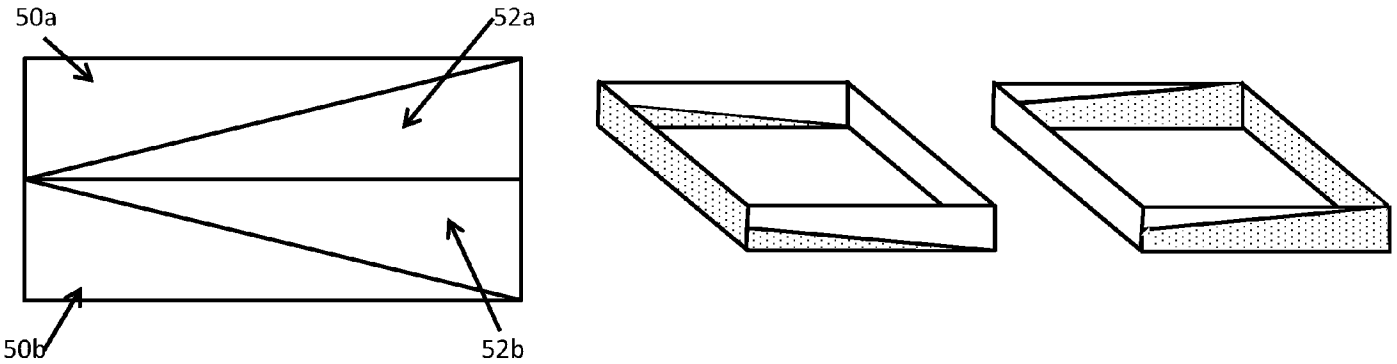
FIG. 6 shows a third design of side wall in accordance with the invention.

FIG. 6 shows an example in which each side wall has two double-triangle areas 50*a*, 52*a* and 50*b*, 52*b* stacked one above the other. The two areas are divided into triangles using opposite diagonals, so that opposite directions of incident sun can be emulated. Thus, the two illumination patterns also shown in FIG. 6 can be obtained. In this way, the lighting arrangement can simulate morning and afternoon illumination effects.

Figure 7:
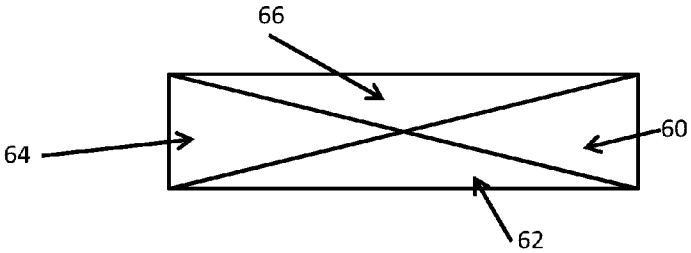
FIG. 7 shows a fourth design of side wall in accordance with the invention.

FIG. 7 shows another example, in which the side walls are segmented into four triangular segments 60, 62, 64 & 66. In this arrangement each side wall comprises a rectangular light emitting area formed from four independently controllable triangular light emitting areas, each having an apex at the center of the rectangular area.

In the examples above, it is assumed that all side walls have the same design. However, for a further improved effect, different side walls can have different designs, and the lighting unit can then be assembled in a particular orientation to best emulate the lighting effects caused by the sun. For example, if the lighting system is to emulate a midsummer day, triangular lighting patterns are desired on the north and south facing side walls, and rectangular lighting patterns are desired on the east and west facing side walls.

Figure 8:
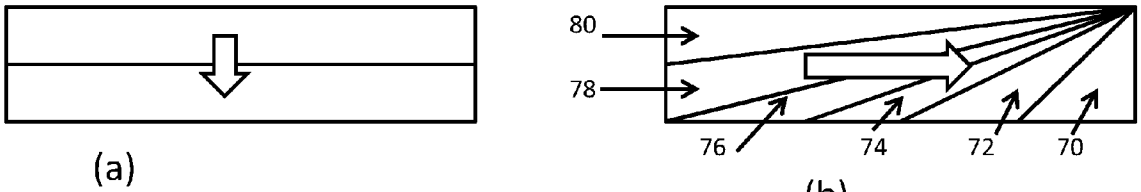
FIG. 8 shows a fifth design of side wall in accordance with the invention.

FIG. 8 shows a further example in which two side walls are formed as multiple rectangles, as shown in FIG. 8(*a*) and the other two are formed as multiple triangles as shown in FIG. 8(*b*).

The side wall shown in FIG. 8(*a*) has two rectangles.

The triangular arrangement of FIG. 8(*b*) has the rectangular light emitting area formed from a plurality of independently controllable triangular light emitting areas 70,72, 74,76,78 and 80, each having an apex at one corner of the rectangular area. This means that boundary lines between triangles at different angles can be formed, so that the movement of the sun can be emulated. There can be any number of these triangles. More triangles enable greater control of the angle between light and dark areas. By way of non-limiting example, there may be between 4 and 12 such triangular areas.

For emulating a low sun position, the directly illuminated side wall (facing the sun) can have one of the two rectangles illuminated at a higher intensity, whereas for a high sun position, both can be illuminated to the same intensity. Thus, the illumination pattern evolves as shown by the arrow, with the illuminated rectangular shape increasing in size as the sun rises (as shown by the arrow), but then decreasing in size as the sun sets.

Similarly, the angle of the triangular boundary can evolve as shown by the arrow in FIG. 8(*b*).

The pattern of FIG. 8(*b*) can only emulate a rising or setting sun. To do both, two mirror image patterns can be stacked in the same manner as shown in FIG. 6.

Additional realism and/or an atmosphere effect can be obtained by using not only white light but also colored light. This can of course be achieved using RGB or RGBW LEDs. By way of example, a gradual change from red to yellow to white light can be provided in the morning to simulate sunrise.

In this case, the light intensity of the artificial skylight panel can be synchronized with the control of the light emitting areas of the side walls. The skylight panel can have very low intensity when the recess side walls are red, increasing up to full intensity (or a user-defined maximum intensity) as the recess color turns to white. During the day, changes in color temperature (warm to cool white) can also change the appearance of the artificial skylight.

In the examples above, the side walls are arranged to emit light. However, the same effect can be obtained by illuminating the side walls indirectly by a light source (e.g. one or more collimated LEDs) from the opposite side. In this case, the side wall provides reflected light, but the shape from which this reflected light is perceived to originate and/or the color is controlled.

The examples given above all make use of rectangular side walls, around a rectangular recess. The recess can be non-rectangular, for example hexagonal, circular, oval, or indeed any other polygonal shape. For a circular or elliptical shape, there will be only one side wall, and different parts of that side wall will be controlled to provide the effects outlined above. This can include indirect lighting, where one part of the single side wall emits light for reflection by an opposing part of the side wall.

The examples above all relate to the use of the lighting system in combination with an artificial skylight, namely a lighting panel used to replicate the appearance of light as would be received from a ceiling window.

In the most preferred implementation, such an artificial skylight is intended to replicate the appearance of a daytime illumination through a skylight (i.e. a window facing the sky). This appearance can include direct directional sunlight or it may be more diffuse to replicate an overcast day. The artificial skylight may also be controllable to replicate moonlight or starlight. The lighting provided by the side walls of the invention can also be chosen to enhance the effect of an artificial skylight which is being controlled to provide a moonlight or starlight. This enhancement can for example comprise control of the color of the light emitted (or reflected) by the side walls, or even to provide a shadow effect as may be perceived from a strongly moonlit sky.

The arrangement of the invention can also be applied to real skylights (i.e. actual windows). This lighting can then be used during cloudy days to create an effect of a sunnier day, or at night to add to the general lighting.

Figure 9:
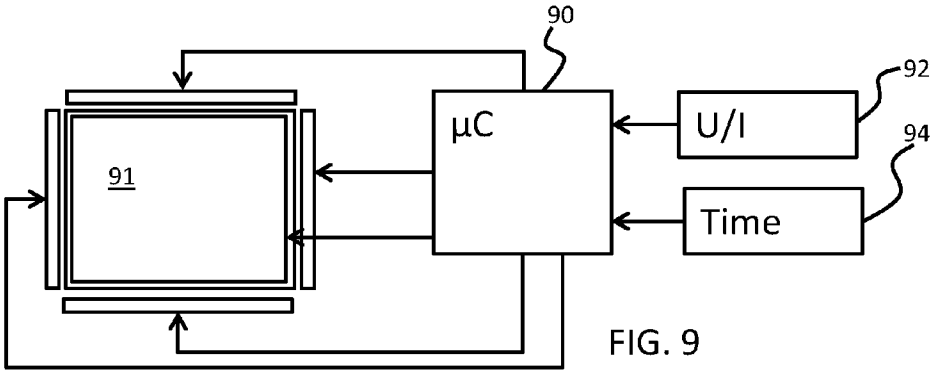
FIG. 9 shows a system in accordance with the invention.

FIG. 9 shows a system of the invention. A controller 90 controls the artificial skylight 91 as well as the side wall light sources of the invention. The controller can operate according to user instructions received from a user interface 92 and/or based on a time value received from a timer 94.

As mentioned above, the artificial skylight can provide a first color for task light emitted in a normal (downward) direction with respect to the light generating area, and a second, different, color (for example with a greater blue component) for light emitted in a direction offset from the normal direction. This is a known dual beam light source. The controller enables changes in the light output of the artificial skylight to be synchronized with changes in the light output of the light sources of the side walls.

The examples above make use of segmented light source areas. At the limit, the side walls may be formed as a pixelated display with a much higher resolution, so that almost continuously varying patterns may be formed to improve even further the realism. Of course, this is more expensive solution than the use of a small number of large area light sources. However, this approach is nevertheless within the scope of the concept underlying the invention.

As discussed above, an area of particular interest is for artificial skylights. However, it should be clear from the description above that the invention also benefits in simulating the effect of sunlight in the case of a real window (skylight or standard vertical window) by creating a bright area on the window frame recess during a cloudy day. This creates the effect of direct sunlight (and a perception that it is less cloudy). This is most effective if the occupant cannot directly see out of the window, for example because he/she is sitting at a large angle or large distance.

The invention also can be applied to an artificial vertical window. The artificial window has a light source that attempts to create a realistic looking view (e.g. picture-like) or gives the (subconscious) impression of a real view (e.g. a very blurred low detail view, possibly with dynamics). Just like for a real window, the realism increases by simulating the effect of direct sunlight.

The controller can be implemented in numerous ways, with software and/or hardware, to perform the various functions required. A processor is one example of a controller which employs one or more microprocessors that may be programmed using software (e.g., microcode) to perform the required functions. A controller may however be implemented with or without employing a processor, and also may be implemented as a combination of dedicated hardware to perform some functions and a processor (e.g., one or more programmed microprocessors and associated circuitry) to perform other functions.

Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media such as volatile and non-volatile computer memory such as RAM, PROM, EPROM, and EEPROM. The storage media may be encoded with one or more programs that, when executed on one or more processors and/or controllers, perform at the required functions. Various storage media may be fixed within a processor or controller or may be transportable, such that the one or more programs stored thereon can be loaded into a processor or controller.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A lighting system comprising:

a light area; and at least one side wall around the light area, defining a recess, wherein:

the light area is located at the base of the recess, and the at least one side wall is provided with a lighting arrangement for controlling at least one of color, intensity, contrast of the illumination, and shape from which light is provided by the at least one side wall, said at least one side wall further comprising a rectangular light emitting area formed from two independently controllable triangular light emitting areas.

2. A lighting system as claimed in claim 1, comprising a set of side walls, wherein at least one of the side walls comprises a rectangular light emitting area formed from four independently controllable triangular light emitting areas, each having an apex at the center of the rectangular area.

3. A lighting system as claimed in claim 1, comprising a set of side walls, wherein at least two side walls each comprises a rectangular light emitting area formed from a plurality of independently controllable triangular light emitting areas, each having an apex at one corner of the rectangular area.

4. A lighting system as claimed in claim 3, comprising four side walls, wherein the said two side walls comprising a rectangular light emitting area formed from a plurality of independently controllable triangular light emitting areas face each other, and the other two side walls each are provided with a plurality of rectangular light emitting areas.

5. A lighting system as claimed in claim 1, wherein the light area comprises a rectangle or square.

6. A lighting system as claimed in claim 1, wherein the light area comprises a light source.

7. A lighting system as claimed in claim 6, wherein the light source provides a first color for light emitted in a normal direction with respect to the light generating area, and a second, different, color for light emitted in a direction offset from the normal direction.

8. A lighting system as claimed in claim 7, wherein the second color has a greater blue component than the first color.

9. A lighting system as claimed in claim 6, further comprising a controller, for controlling the light source of the transmitting or light generating area in synchronism with the lighting arrangement of the side wall or side walls.

10. A lighting system as claimed in claim 1, wherein the light area comprises a window.

11. A lighting system as claimed in claim 1, wherein the lighting arrangement of the at least one side wall or each side wall is for emitting light from the side wall or side walls to an observer.

12. A lighting system as claimed in claim 1, wherein the lighting arrangement of the at least one side wall or each side wall is for emitting light from the side wall or side walls to an opposing side wall or opposing part of the side wall, for reflection to the observer.

13. A lighting system as claimed in claim 1, wherein the lighting arrangement of the at least one side wall or each side wall has a controllable output color.

* * * * *